US005088401A

United States Patent [19]

Fujino et al.

[11] Patent Number: 5,088,401

[45] Date of Patent: Feb. 18, 1992

[54] MARKING METHOD AND APPARATUS

[75] Inventors: Noboru Fujino; Tohru Takamura, both of Tokyo, Japan

[73] Assignee: Kabushiki Kaisha Shinkawa, Tokyo, Japan

[21] Appl. No.: 621,224

[22] Filed: Nov. 30, 1990

[51] Int. Cl.[5] ..... B41F 17/00

[52] U.S. Cl. ..... 101/41; 101/163; 101/489; 101/DIG. 30

[58] Field of Search ..... 101/41, 44, 163, 42, 101/43, DIG. 30, 486, 484

[56] References Cited

U.S. PATENT DOCUMENTS

| | | | |
|---|---|---|---|
| 3,530,792 | 9/1970 | Valiela | 101/41 |
| 3,837,276 | 9/1974 | Reichert | 101/41 |
| 3,898,926 | 8/1975 | Peres | 101/37 |
| 3,960,072 | 6/1976 | Ahlgren | 101/35 |
| 4,111,624 | 9/1978 | Hanson | 425/135 |

FOREIGN PATENT DOCUMENTS

| | | | |
|---|---|---|---|
| 21986 | 1/1981 | European Pat. Off. | 101/44 |
| 3432909 | 3/1986 | Fed. Rep. of Germany | 101/41 |
| 3535863 | 4/1987 | Fed. Rep. of Germany | 101/41 |
| 56866 | 5/1981 | Japan | 101/41 |
| 71160 | 4/1983 | Japan | 101/41 |

*Primary Examiner*—Edgar S. Burr
*Assistant Examiner*—Eric Raciti
*Attorney, Agent, or Firm*—Koda and Androlia

[57] ABSTRACT

In the marking method and apparatus, a printing plate which is mounted to a plate holder is moved horizontally and vertically and set above a workpiece. The printing plate is then lowered quickly until it comes into contact with the workpiece upon which printing is performed and then, based upon a signal from a detector which detects such a contact of the printing plate to the workpiece, the printing plate is further lowered slowly a predetermined fixed distance. Thus, even if the thickness of the workpiece is different from workpiece to workpiece, the pressing-in amount of the printing plate into the workpiece can be constant for different workpieces.

3 Claims, 2 Drawing Sheets

FIG.3
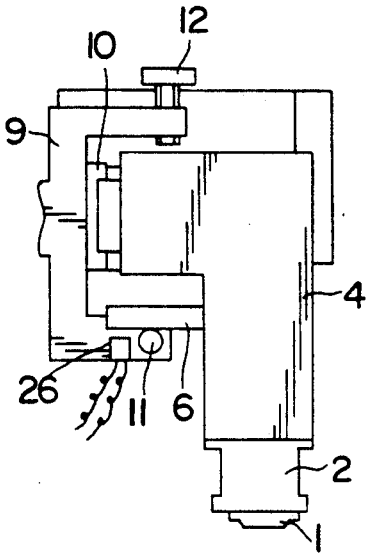
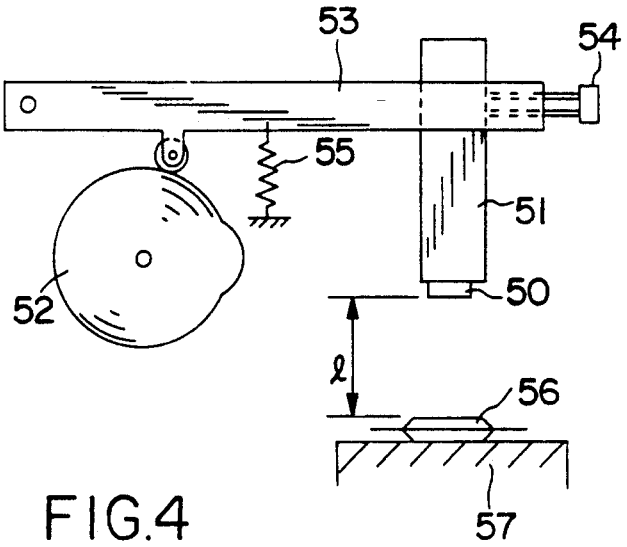
FIG.4
PRIOR ART

MARKING METHOD AND APPARATUS

BACKGROUND OF THE INVENTION

1. Field of the Invention

The present invention relates to a marking method and apparatus which use relief-plate printing.

2. Prior Art

In conventional marking devices, as shown in FIG. 4, a printing plate 50 is attached to a plate holder 51, and the plate holder 51 is mounted to a pivotal lever 53 via screw 54. The pivotal lever 53 pivots up and down by a cam 52. A spring 55 pulls the lever 53 towards the cam 52 so that the lever 53 steadily follows the surface of the cam 52. Reference numeral 56 is a workpiece upon which printing is performed. The workpiece 56 is positioned and carried on a workpiece carrying table 57.

In this prior art apparatus, since the plate holder 51 is driven up and down via the cam 52, the distance the printing plate 50 is lowered is fixed. If the thickness or height of the workpiece 50 is different, the press-in distance of the printing plate 50 into the workpiece is not consistent from workpiece to workpiece. As a result, the thickness of the printed characters differs, and uniform printed characters cannot be obtained.

SUMMARY OF THE INVENTION

Accordingly, the object of the present invention is to provide a marking method and apparatus which sets a constant pressing-in distance of the printing plate into the workpiece, so that uniform printing is accomplished.

The marking method of the present invention is characterized in that (a) a plate holder to which a printing plate is attached is caused to move up and down by a Z-direction (or vertically) driving motor, (b) a detection means detects the moment the printing plate comes into contact with the workpiece, and (c) the plate holder is lowered by a fixed amount upon a signal provided by the detection means.

The marking apparatus of the present invention includes (a) a plate holder to which a printing plate is attached, (b) a moving table which supports the plate holder so that the plate holder is free to move up and down and that the plate holder moves up and down following the table movement, (c) a Z-direction driving motor which drives the moving table in a vertical direction, (d) a detection means which detects the point at which the plate holder no longer follows the moving table (after the printing plate has come into contact with the workpiece), and (e) a control means which controls the Z-direction driving motor so that the plate holder is lowered by a fixed distance in accordance with a signal from the detection means.

In the method and apparatus of the present invention, the plate holder is lowered a fixed distance from a point at which the printing plate comes into contact with the workpiece. Accordingly, even if the thickness of the workpieces is different from workpiece to workpiece, the pressing-in amount of the printing plate from the top surface of the workpiece can be constant for different workpieces. Accordingly, uniform printing can be achieved. Even if the thickness of the workpiece changes, there is no need to adjust the height of the plate holder.

BRIEF DESCRIPTION OF THE DRAWINGS

FIG. 3 is a front view of essential sections of another embodiment of the present invention; and FIG. 4 is a schematic explanatory diagram which illustrates a conventional example.

DETAILED DESCRIPTION OF THE INVENTION

One embodiment of the present invention will be described with reference to FIGS. 1 and 2.

Figure 1:
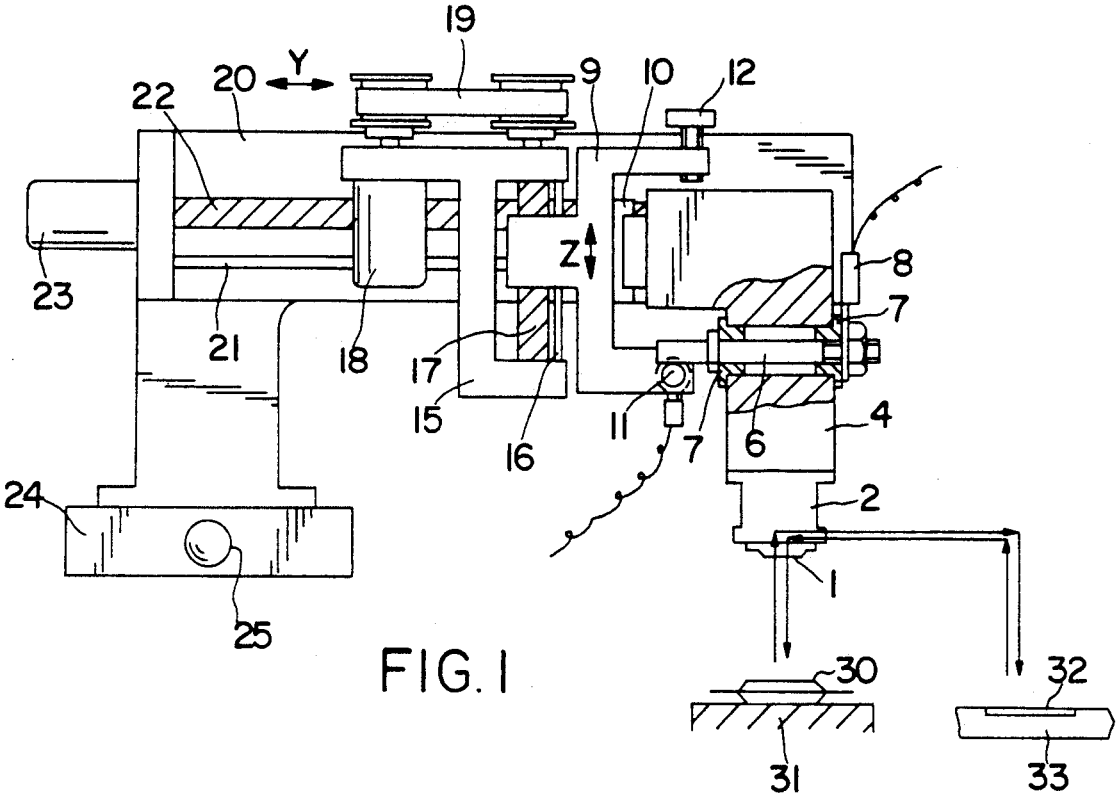
FIG. 1 is a front view which illustrates a marking apparatus according to the present invention.

As shown in FIG. 1, a plate holder 2 to which a printing plate (rubber stamp) 1 is bonded is detachably attached to a plate holder attachment 4.

A first contact rod 6 made of an electrically conductive material is attached to the plate holder attachment 4 via insulators 7. An electrical terminal 8 is connected to one end of this contact rod 6.

The plate holder attachment 4 is mounted on a first moving table 9 via a linear guide 10 in such a way that the plate holder attachment 4 is free to move up and down.

A second contact rod 11 made of electrically conductive material is fixed to the lower end of a first moving table 9. The second contact rod 11 contacts the undersurface of the first contact rod 6.

A stopper 12 is screwed into the upper end of the first moving table 9 so as to face the upper surface of the plate Thus, when the first moving table 9 moves up and down, the plate holder attachment 4 is caused to move via the contact rods 11 and 6.

The stopper 12 is set so that a gap of approximately 50 microns remains between the stopper 12 and the plate holder attachment 4 when the contact rods 6 and 11 are in contact with each other. The second contact rod 11 is connected to a ground line.

The first moving table 9 slides along a guide rod 16 which is installed uprightly on a second moving table 15. The first moving table 9 is mounted on a Z-direction (vertical direction) feed screw,. 17 which is parallel to the guide rod 16 and rotatably mounted on the second moving table 15. This Z-direction feed screw 17 is driven via a belt 19 by a Z-direction driving motor 18 which is mounted on the second moving table 15.

The second moving table 15 slides along a guide rod 21 which is installed in a horizontal Y direction on a third moving table 20. The second moving table 15 is engaged with a Y-direction (horizontal direction) feed screw 22 which is supported parallel to the guide rod 21 on the third moving table 20. The Y-direction feed screw 22 is driven by a Y-direction driving motor 23 which is mounted on the third moving table 20.

The third moving table 20 is provided on a base 24 so that the table 20 slides in the horizontal direction. The third moving table 20 is driven via an X-direction feed screw (not shown) by an X-direction driving motor 25 mounted on the base 24.

Accordingly, when the Z-direction driving motor 18 is driven, the Z-direction feed screw 17 is rotated via the belt 19, and the first moving table 9 is caused to move in the Z direction (vertical). As a result, the plate holder 2 is moved in the Z direction together with the plate holder attachment 4.

When the Y-direction driving motor 23 is driven, the second moving table 15 is caused to move in the Y (horizontal) direction by the Y-direction feed screw 22, so that the plate holder 2 is moved in the Y direction.

Similarly, when the X-direction driving motor 25 is driven, the third moving table 20 is caused to move in the horizontal X direction, so that the plate holder 2 is caused to move in the X direction.

An ink stand 33 containing ink 32 is installed at a position away, in the Y direction, from the position of a workpiece carrying table 31. A workpiece 30 on which printing is performed is positioned and carried on this table 31.

Printing is accomplished by repeating the action indicated by the arrows shown at right-hand bottom corner of FIG. 1, wherein ink 32 is first applied to the printing plate 1, and the workpiece 30 is printed with such ink. This action is accomplished by a combination of (a) the movements of the plate holder 2 in the Z direction as driven by the Z-direction driving motor 18 and (b) the movements of the plate holder 2 in the X direction as driven by the X-direction driving motor.

Figure 2:
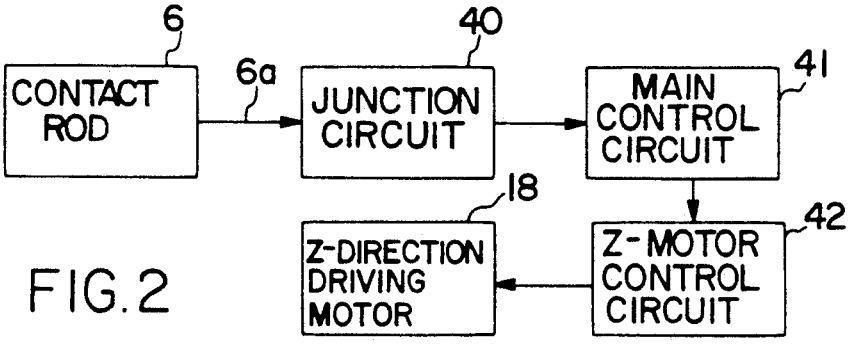
FIG. 2 is circuit diagram utilized in the embodiment of FIG. 1.

As shown in FIG. 2, signal 6*a* generated by the first contact rod 6 when the second contact rod 11 is separated from the first contact rod 6 is inputted in a main control circuit 41 via a junction circuit 40. The main control circuit 41 controls the motors 5, 18, 23 and 25 and also controls the feeding of the workpiece 30. When the signal 6*a* is inputted in the main control circuit 41, the circuit 41 outputs a signal which control the Z-direction driving motor 18 via a Z-motor control circuit 42.

A method for setting a distance between the printing plate 1 and the workpiece 30 will be described below.

With the printing plate 1 positioned above the workpiece 30, the Z-direction driving motor 18 is driven so that the plate holder 2 is lowered. The position of the printing plate 1 prior to the start of this lowering action is stored beforehand in the main control circuit 41. The position of the printing plate 1 can easily be ascertained if an encoder-equipped motor is used as the Z-direction driving motor 18.

The lowering of the plate holder 2 can be performed manually by an operator using a universally known electrical chessman (not shown) to drive the Z-direction driving motor 18 is driven one pulse at a time.

If, after the printing plate 1 has come into contact with the workpiece 30, the first moving table 9 comes down further, the first contact rod 6 is lowered along with the second lowers until the printing plate 1 is compressed by the weights of the plate holder attachment 4 and elements 1 through 3 and 5 through 8. During this lowering action, the first contact rod 6 is kept in contact with the second contact rod 11.

The plate holder attachment 4 is not lowered further once the printing plate 1 has compressed the workpiece 30, and only the first moving table 9 continues lowering. As a result, the second contact rod 11 is separated from the first contact rod 6, and an "off" signal 6*a* is outputted from the first contact rod 6.

The amount of compression (or depth of the compressing) of the printing plate 1 varies depending upon the material of the printing plate 1. Such an amount is ordinarily about 50 microns. Taking this amount in consideration, a position 50 microns above the detection point is designated as a "Z level" (which is distance to the surface of the workpiece 30). Thus, the distance between the printing plate 1 and the workpiece 30 can be ascertained.

In use, the plate holder 2 is rapidly lowered to a point approximately 200 microns above the detection point (i.e., a point approximately 150 microns above the Z level). This point is designated as a "search level." After that point, the plate holder 2 is lowered slowly. This action is stored in the main control circuit 41. By storing the information of lowering action, the lowering time of the plate holder 2 can be saved. The distance the plate holder 2 is lowered (i.e., the pressing-in distance of the printing plate 1) is set beforehand in the main control circuit 41 with the output of the signal 6*a* as a criterion.

The printing operation will be described below.

When a start button (not shown) is pressed, the plate holder 2 is rapidly lowered to the search level (located approximately 150 microns above the workpiece 30) from the starting position above the workpiece 30. The plate holder 2 is then lowered slowly, and the printing plate 1 contacts the workpiece 30. After this, the first contact rod 6 is lowered by the lowering action of the second contact rod 11 (while kept in contact with the second contact rod 11) until the workpiece 30 is compressed for a given amount by the weights of the elements 1 through 8.

Afterward, the plate holder attachment 4 is no longer lowered. Instead, the first moving table 9 alone is lowered. As a result, the second contact rod 11 is separated from the first contact rod 6, causing an "off" signal 6*a* to be outputted from the first contact rod 6.

Based upon this detection signal, the main control circuit 41 outputs a signal which causes the printing plate 1 to be lowered the pressing-in distance (which is stored beforehand in the main control circuit 41). As a result, the first moving table 9 is first lowered a distance which corresponds to the gap between the stopper 12 and the plate holder attachment 4, whereupon the stopper 12 contacts the plate holder attachment 4. Accordingly, when the first moving table 9 is further lowered from this point, the plate holder attachment 4 is pressed by the stopper 12, so that the printing plate 1 is pressed against the workpiece 30. As a result, printing is performed.

As described above, since the Z-direction driving motor 18 is driven a fixed amount by the main control circuit 41 via the Z-motor control circuit 42 (based upon the signal 6*a*), printing is achieved evenly even if there is some differences in the thickness of the workpieces 30. This is because the amount of distance of pressing-in of the printing plate 1 from the top surface of the workpiece 30 is consistent.

FIG. 3 illustrates another embodiment of the present invention. In the embodiment of FIG. 1, the point of contact is detected by the on/off action of the contact rods 6 and 11. In this embodiment of FIG. 3, the contact rods 6 and 11 merely act as supporting rods.

More specifically, a non-contact type sensor 26 is attached to the first moving table 9. A fixed gap is maintained between the sensor 26 and the first contact rod 6. The contact point is detected based upon changes in the distance between the sensor 26 and the first contact rod 6. The sensor 26 does not necessarily face the first contact rod 6 and can face an arbitrary position of the plate holder attachment 4.

According to the present invention, as is clear from the above description, the plate holder is lowered a fixed distance from the point where the printing plate comes into contact with the workpiece. Accordingly, even if the thickness of the workpieces are different, the distance of pressing-in of the printing plate from the top surface of the workpiece can be consistent for every workpiece. Thus, uniform printing is achieved. In addition, even if the thickness of the workpieces should change, there is no need to adjust the height of the plate holder.

We claim:

1. An apparatus for marking a workpiece characterized in that said apparatus comprises: (a) a plate holder to which a printing plate is attached, (b) a moving table to which said plate holder is mounted so that said plate holder is free to move up and down and that said plate holder moves up and down following said table, (c) a Z-direction motor means for driving said moving table in the Z-direction and bringing said plate into contact with the workpiece, (d) a detection means which detects the point at which the printing plate contacts the workpiece, and (e) a control means which controls the Z-direction driving motor so that the plate holder is lowered by a fixed amount after the detection means detects the point the printing plate contacts said workpiece.

2. A marking method comprising (a) causing a plate holder to which a printing plate is attached to move up and down by means of a Z-direction driving motor, (b) detecting with a detection means the moment said printing plate contacts a workpiece, and (c) lowering said plate holder by a fixed amount by means of said Z-direction driving motor after the detection means detects the moment said printing plate contacts said workpiece.

3. A marking method comprising:

positioning a plate holder to which a printing plate is attached above a workpiece;

moving said plate holder down so that said printing plate comes into contact with said workpiece;

generating a detection signal indicating said contact of said printing plate with said workpiece; and lowering said plate holder a predetermined distance after said detection signal is generated so that said printing plate is pressed into said workpiece to perform printing on said workpiece.

* * * * *